United States Patent [19]

Brassel

[11] 4,116,621

[45] Sep. 26, 1978

[54] FEEDING CHUTE OR GATE

[75] Inventor: Leo Brassel, Kalenborn, Fed. Rep. of Germany

[73] Assignee: Schmelzbasaltwerk Kalenborn, Dr. Ing. Mauritz KG, Kalenborn, Fed. Rep. of Germany

[21] Appl. No.: 778,062

[22] Filed: Mar. 9, 1977

[51] Int. Cl.[2] ..... F27D 9/00; F27D 9/12

[52] U.S. Cl. ..... 432/233; 65/326; 432/239

[58] Field of Search ..... 432/233, 239; 65/225, 65/325, 326, 327

[56] References Cited

U.S. PATENT DOCUMENTS

| | | | |
|---|---|---|---|
| 1,766,979 | 6/1930 | Canfield | 65/225 X |
| 2,019,048 | 10/1935 | Hellmers et al. | 65/225 X |
| 2,598,955 | 6/1952 | Winder | 65/225 X |
| 2,772,517 | 12/1956 | Bowes | 65/327 X |
| 3,498,779 | 3/1970 | Hathaway | 62/327 |

*Primary Examiner*—John J. Camby

[57] ABSTRACT

A gate for casting molten material, including smelting basalt, in spin-casting molds. The gate includes a curved channel, and means for cooling the channel so as to attain a temperature required for mold spinning operations. The channel includes a main vertical section having a steep impact zone, a drawn-back inlet section and an inclined horizontal end section.

12 Claims, 4 Drawing Figures

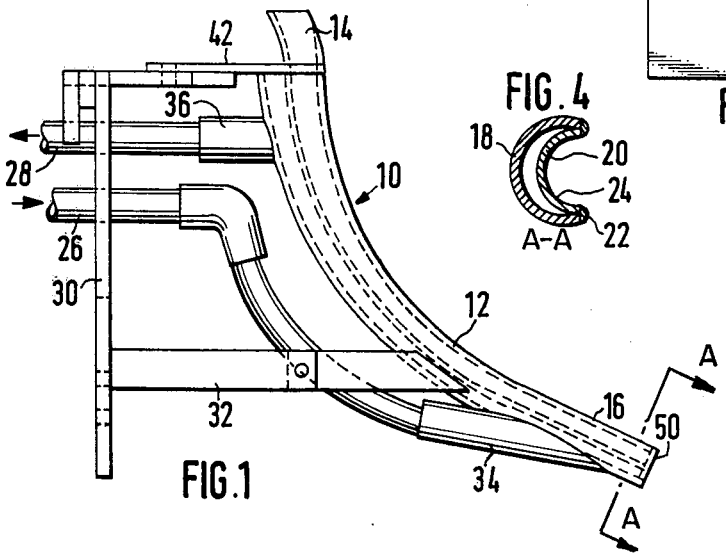
FIG. 1
FIG. 4
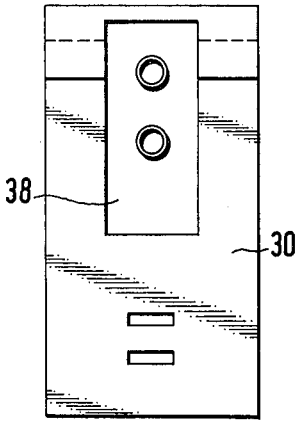
FIG. 2
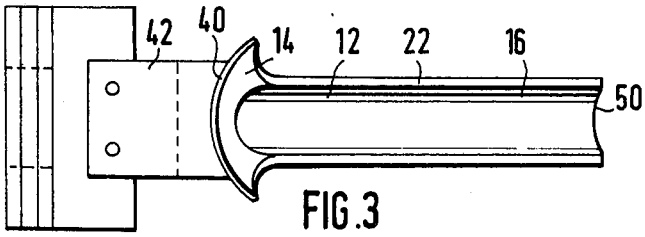
FIG. 3

FEEDING CHUTE OR GATE

The invention relates to a gate for casting molten materials, such as smelting basalt, and in particular to a gate for spin-casting molds.

Gates for spin-casting molds used for casting iron or similar materials, are produced, for example, from a foundation of fire-brick and a lining of sticky clay sand, through which the molten cast iron flows. Ceramic material has proven itself very well as a material used in construction of gates. The concept underlying the construction of such gates went in the direction of insulating the gates as far as possible against the dissipation of heat out of the molten cast iron or molten steel, i.e., to construct them in such a way that the heart did not dissipate, but was rather maintained.

Surprisingly, the results in the casting of smelting basalt from such gates were not very encouraging. The products cast in the associated spin-casting forms failed to meet satisfactory quality standards.

The dolomite bricks which were used on a trial basis for lining the casting channels led to the same unsatisfactory results.

On the other hand, new and unexpected results are obtained in the present invention when, in a gate for casting molten materials such as smelting basalt, the channel is water-cooled.

Preferably the channel is cooled on the reverse side with water in a reverse current to the flow of smelting basalt.

It is essential that the channel itself consists of a material of good heat-conductivity.

Preferably the channel is produced of copper, in particular of hard-drawn copper tube.

It is preferable that the copper channel be polished.

This favorable effect for the spin-casting is brought about by the form of the channel, which is essentially curved in a semicircular manner, in such a way that laterally projecting walls formed on both sides of the channel.

The best results were yielded for the rerouting, in the channel, of a liquid smelting basalt stream at temperatures of 1200° C.

The channel form was selected in such a way that the copper channel conveys the in-flowing stream in such a way that it cannot be diverted laterally. A damming-up of the molten basalt is avoided by means of the construction in the steep zone, in which a tangential impacting is brought about.

What is achieved is that the molten basalt does not adhere. As a result of the construction of the channel with high heat-conductivity and with additional water cooling, the temperature necessary for the spinning operation is achieved. The temperature required for the formation of the ends of the tube to be spun, must be relatively low in order to keep down the shrinkage effect and to prevent a fin formation.

Furthermore, by employing the water cooled embodiment, the sprue can be fixed in the middle of the spin mold, which, in turn, permits a uniform distribution of the smelting basalt stream during the spinning operation.

A sample embodiment form of the invention is now to be more specifically explained with reference to the attached drawings, in which:

FIG. 1 shows a side view;

FIG. 2 shows an end view;

FIG. 3 shows a plan view; and

FIG. 4 shows a partial section along the line A—A in FIG. 1.

In the following, wherever there is a discussion of various parts of the channel, what is involved is only conceptual or optional parts which serve the description but are not to be recognized as such in the embodiment form.

According to the water-cooled embodiment form, the channel 10 consists of a drawn-back inlet section 14, a channel main section 12 and a straight, inclined channel section 16. The impact region for the molten basalt stream is in the first third of the channel main section 12. The impact point is, in turn, dependent on the point of the impacting basalt stream. In general, the impact point is, however, situated at the height of the outlet connection, which is to be described later.

The channel profile, depicted particularly in FIG. 4, is symmetrical. The inner wall 20 has a substantially smaller radius of curvature than the outer wall 18. Between each other, the inner and outer wall enclose a space which serves for the water cooling, and they are welded together at the ends 22. At the end 50, the channel profile is embodied symmetrically and drawn-inward in accordance with the flow-off requirements.

The water cooling is carried out via the inlet pipe 26 and the inlet connection 34; the discharge via discharge connection 36 and water outlet pipe 28. In the region of the impact point and around the flow-off region 50, installations (not shown) are provided to ensure an especially strong cooling effect in these regions. Above, in the transition between regions 12 and 14, the channel is held by a horizontal plate 42. The discharge tube 28 transverses a vertical carrier plate 30. Directly underneath the discharge tube, plate 30 is transversed in the same manner by the inlet tube 26. Finally, the channel is also supported, in the lower section of the channel main section 12, by means of a carrier bracket 32. The feed and drain lines are conveyed through the opening 38 in the carrier plate 30. After the convergence of outer wall 18 and polished inner wall 24, the channel ends with the drawn-back inlet section 14, which has an arcuate wall 40, defining its outer periphery

EXAMPLE

The channel is produced out of hard-drawn copper tube which is polished on the inside 24. The wall thickness amounts to 5 mm. The inside radius of the inner wall 20 equals 22.5 mm; the inner radius of the outer wall 18 equals 40 mm. The channel main section extends over an arc of 65°. The radius at the welded or, respectively, the hard-soldered tube ends 22, is equal to 225 mm, and that of the inside edge of the outer wall is equal to 266 mm. The result is a radius of 258 mm for the arc of the main section for the polished channel bottom. The height of the channel main section (steep zone) was about 200 mm on the inner edge side, about 230 mm on the outer edge side. The inlet 14 has a height of 40 mm and is drawn back, from the vertical, to an angle of 65° against the horizontal. The length of the straight, inclined channel section 16 amounts to 175 mm with an inclination of 25°.

The excellent results obtained according to the invention can possibly be traced back to the fact that basalt has a relatively small heat conductivity and that the advantages—no adhesion— come about as a result of the rapid dissipation of the heat. Material stresses as a result of the temperature effect were not to be anticipated. As a result of the counter-current cooling, the channel was sufficiently cooled even at the most stressed zones, namely, at the impact point and the end section. At the latter locations, radiant heat resulting from the proximity of the casting operation, thermally affects the channel. As a consequence of employing the prescribed glide angle, there resulted a flawless flow-off of the basalt, without damming up. A output of 30–60 kg per minute was achieved in a channel of this type. Another factor contributing to reduction of the heat level, particularly in the channel bottom, is the waiting time required until the production of the next spin-cast tube.

The material utilized for the hard-drawn copper tube is of the same kind as used in water pipes for home installations.

What is claimed is:

1. A gate for casting molten material, including smelting basalt, which gate, particularly useful for spin-casting molds, comprises:

a channel having a main section, an end section, and a drawn-back inlet section, said main section having an impact region for the molten basalt stream located in the first third thereof, said inlet section being located above said impact region and provided with an arcuate wall defining the outer periphery thereof; and means for cooling said channel so as to attain a temperature required for spinning operations.

2. The gate of claim 1, wherein the cooling means are employed for cooling the channel on the reverse side with water in a countercurrent to smelting basalt flow therein.

3. The gate of claim 2, further comprising means for effecting extra cooling to the impact region and end section of the channel.

4. The gate of claim 1, wherein the channel consists of material of good thermal conductivity.

5. The gate of claim 4, wherein the channel consists of copper, particularly of hard-drawn copper tube.

6. The gate of claim 4, wherein the channel consists of polished copper.

7. The gate of claim 1, wherein the channel further comprises an essentially curved cross-section, such that laterally projecting walls are formed on opposite sides of the channel.

8. The gate of claim 1, wherein said impact region of the main section of the channel is constructed tangentially to the casting stream and is nearly vertical in position.

9. The gate of claim 1, wherein the channel further comprises a straight-inclined section, inclined at about 25° to the horizontal, and connected to the main section thereof.

10. The gate of claim 1, wherein the main section of the channel spans an arc of about 65°, starting from the vertical.

11. The gate of claim 1, wherein said drawn-back section is bent back 65°, starting from the vertical, at the transition to the main section of the channel, and ending against the horizontal.

12. The gate of claim 1, wherein the channel further comprises a symmetrical cross-section which is defined by inner and outer walls welded together at the ends thereof, said inner wall having a substantially smaller radius of curvature than said outer wall and said inner and outer walls enclosing a space which serves for the water cooling.

* * * * *